United States Patent [19]

Buchholz

[11] 4,127,946

[45] Dec. 5, 1978

[54] METHOD FOR STEAM DRYING

[76] Inventor: Adolf Buchholz, 11694 SE. Clover La., Portland, Oreg. 97266

[21] Appl. No.: 799,362

[22] Filed: May 23, 1977

Related U.S. Application Data

[62] Division of Ser. No. 550,573, Feb. 18, 1975, Pat. No. 4,026,037.

[51] Int. Cl.[2] ..... F26B 3/00

[52] U.S. Cl. ..... 34/28; 34/16.5; 34/33

[58] Field of Search ..... 34/10, 15, 28, 33, 77, 34/16.5

[56] References Cited

U.S. PATENT DOCUMENTS

| | | | |
|---|---|---|---|
| 2,284,838 | 6/1942 | Oholm | 34/213 X |
| 2,296,546 | 9/1942 | Toney | 34/26 X |
| 2,758,386 | 8/1956 | Cobb | 34/213 |
| 3,434,222 | 3/1969 | Malmquist | 34/16.5 |
| 3,474,544 | 10/1969 | Holden, Jr. et al. | 34/216 X |

*Primary Examiner*—John J. Camby

*Attorney, Agent, or Firm*—Klarquist, Sparkman, Campbell, Leigh, Hall & Whinston

[57] ABSTRACT

A method and apparatus are disclosed for drying materials by contact with a drying gas consisting essentially of internally generated superheated drying steam above 212° F., to vaporize the water in the material and remove it to produce the steam used for drying. A minor portion of steam is removed from the drying gas and discarded to maintain pressure equilibrium. The drying steam is produced within the drying chamber from water evaporated from the material being dried and is either heated within the drying zone where it is in contact with the material or removed from the drying zone, heated to form superheated steam, and returned to the drying zone for contact with the material during drying. A wood veneer dryer employing the invention is described as well as an apparatus for drying particulate material. The drying zones provided with the veneer dryer have at least along the major portions of their lengths a negative internal pressure which is below that of the ambient external atmosphere outside the dryer to prevent pollutants from leaking out of the dryer and ambient air is prevented from entering the dryer into such drying zone.

10 Claims, 3 Drawing Figures

METHOD FOR STEAM DRYING

This is a division of application Ser. No. 550,573, filed Feb. 18, 1975, issued May 31, 1977 as U.S. Pat. No. 4,026,037.

BACKGROUND OF THE INVENTION

The present invention relates to a process and apparatus for drying water-containing materials. More particularly, the present invention relates to a process and apparatus for drying materials with internally generated superheated steam in a drying zone while preventing ambient air from entering such drying zone. In one aspect, the present invention relates to a method and apparatus for drying thin sheet materials such as wood veneer. In another aspect the invention relates to a process for drying particulate materials.

Wood veneer is normally dried by passing large volumes of hot air over the veneer sheets. The water content of the hot air is usually about 5 percent, but may be as high as 30 percent or more in unusual cases. When overly hot air contacts the veneer, the surface of the veneer begins drying immediately and very rapidly dries out completely, becoming overly hot, while the interior of the veneer is still relatively cool and moist. This temperature gradient, and the resulting moisture gradient in the veneer cause hardening, cracking and general degradation of the veneer. For this reason, the wood veneer drying art has resorted to relatively low drying air temperatures and long drying times.

It is desirable to have a uniform moisture content in the veneer after drying is completed. In conventional veneer drying the outer surface of the veneer is overly dry after drying is completed, while the interior of the veneer remains overly moist. Moreover, sheets of veneer dried at different times in the same dryer often have different moisture contents, making it difficult to glue the veneer uniformly to produce plywood.

A major problem in the veneer drying art has been disposal of large amounts of hydrocarbonaceous vapors which are evolved from the veneer during drying. The hydrocarbonaceous vapors are removed from the veneer by hot air in the dryer and carried out of the dryer up a smoke stack along with the air. In the past, after the hot air has been used in drying, it has simply been discarded up the stack and released into the atmosphere. In addition much of hydrocarbon vapor leaks out of door seals and cracks in the veneer dryer as "fugitive emissions" because of the positive pressure created within the dryer. This has caused severe air pollution problems. Under present environmental restrictions, it has become necessary to curb release into the atmosphere of such hydrocarbonaceous vapors.

Drying of particulate materials such as seeds, alfalfa, manure, etc., has also been accomplished by contacting the materials with large volumes of hot air, Typically, air has been taken from the atmosphere and heated, contacted with the material to be dried, and then simply released back into the atmosphere. Heat energy imparted to the air before it is used in drying is thus lost when the air is released. Air drying of particulates, like air drying of veneer, has created air pollution problems as a result of production of various volatile materials stripped from the drying particulate material by the hot drying air, which have simply been released into the atmosphere along with used air.

Conventional air drying of particulates is relatively uneconomical in that the heat energy imparted to air used in drying is wasted. Further, it has been found difficult and expensive to remove volatile pollutants from the heated air after use in drying, before the air is returned to the atmosphere.

These problems of pollution control and energy waste are overcome by the steam drying method and apparatus of the present invention. While superheated steam has been used previously in batch drying systems for conditioning and drying heavy lumber, and has been suggested for increased humidity to prevent fires in the operation of veneer dryers along with reduced air inflow for heat conservation, as discussed by S. E. Corder in *Forest Products Journal,* October 1963, pages 449 to 453 it has been employed along with means for producing a negative internal pressure within the drying chamber in continuous production drying systems such as those used for drying wood veneer or particulates to prevent the fugitive emission of pollutants from such chamber into the plant containing such dryer.

SUMMARY OF THE INVENTION

It is an object of the present invention to provide a method and apparatus for drying water-containing materials in a more rapid and efficient manner than possible using conventional drying systems.

It is another object of the present invention to provide a drying method and apparatus for drying thin sheets and particulates which employ a drying medium consisting essentially of internally generated superheated steam and prevent ambient air from entering the drying zone.

It is a further object of the present invention to provide a drying method and apparatus which conserves heat energy loss and reduces atmospheric pollution from pollutants stripped from a material during drying.

It is a further object of the present invention to provide a drying method and apparatus for drying a water-containing material to a substantially uniform water content at the surface and in the interior of the material.

It is a further object of this invention to provide a veneer dryer having increased production capacity.

It is a further object of this invention to provide a veneer dryer method and apparatus which allows automatic regulation of the internal pressure in a veneer dryer.

It is a further object of the present invention to provide a drying method and apparatus for efficient drying of water-containing materials and reducing breakdown and degradation of the dried materials.

In one embodiment, the present invention relates to a drying method for removing water from a water-containing material, which includes contacting the material with a drying gas consisting essentially of steam, at a temperature higher than 212° F., at atmospheric pressure or lower, so that at least the major portion of such drying gas is superheated steam vaporizing water in the material, heating the drying steam to maintain a temperature above 212° F., and discarding a small portion of the drying steam to maintain the desired pressure.

In another embodiment, the present invention relates to drying apparatus for removing water absorbed in a material, which includes a container for holding the material, heating means for providing a heating fluid consisting essentially of superheated steam in the container, so that at least a major portion of said heating fluid is superheated steam means for preventing ambient air from entering said container, and means for removing a portion of the heating fluid from the container to maintain a desired pressure therein.

BRIEF DESCRIPTION OF THE DRAWINGS

Other objects and advantages of the present invention will be apparent from the following detailed description of certain preferred embodiments thereof and from the attached drawings.

DETAILED DESCRIPTION OF PREFERRED EMBODIMENT OF THE INVENTION

Figure 1:
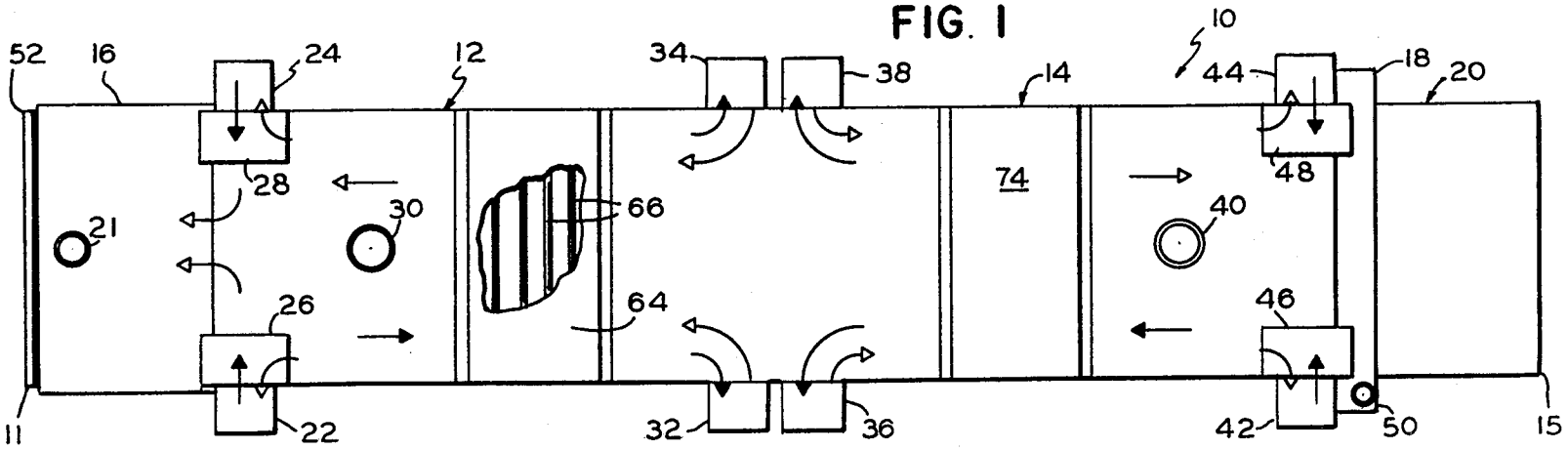
FIG. 1 is a top view of a veneer dryer which has been modified for drying veneer sheets according to the present invention, the flow of drying air in its former conventional operation being depicted by solid arrows, and the flow of superheated steam after modification according to the present invention being shown by outlined arrows.

The present invention may be employed for drying a variety of sheet or particulate moist or wet materials. The invention is particularly useful in drying organic materials such as wood veneer, seeds, alfalfa, manure, etc.

This invention is particularly adapted for drying of wood veneer to be used in making plywood. The use of the present invention in drying veneer sheets can best be understood by reference to FIGS. 1 and 2 which show a veneer dryer 10 in accordance with a preferred embodiment of the present invention. Green or undried sheets of wood veneer are introduced into the dryer 10 at an inlet end 11 thereof, moving into a green end drying section 12. Sheets pass longitudinally through the dryer 10 from green end drying section 12 into dry end drying section 14. The dried veneer sheets are ultimately withdrawn at the outlet end 15 of dryer 10.

According to the present invention, an entrance hood 16 is provided over the area where wood veneer sheets enter drying section 12. Likewise, an exit hood 18 is provided over the area where dried veneer sheets exit from drying section 14 into a conventional veneer cooler 20, attached to the outlet of drying section 14.

Hood 16 has a smoke or exhaust stack 21 extending upward from its top. At the inlet end of green end drying section 12, the dryer 10 is provided with two laterally attached, vertically extending, heating gas ducts 22 and 24 on opposite sides of drying section 12. Vertical ducts 22 and 24 lead, respectively, into two blower fan housings 26 and 28, which are mounted on the roof of drying unit 10. A conventionally placed exhaust stack 30, not utilized in the present invention, is shown extending upward from the top of green end drying section 12. Green end drying section 12 has two vertically extending ducts 32 and 34 positioned on opposite sides thereof at its outlet end near the center of dryer 10.

Dry end dying section 1. is likewise equipped with two laterally positioned vertically extending ducts 36 and 38, on opposite sides of its inlet end near the center of dryer 10. A conventionally placed stack 40, not utilized in the present invention, is shown extending upward from the roof of drying section 14. Dry end drying section 14 is equipped, on opposite sides of the outlet end thereof adjacent hood 18, with two laterally positioned, vertically extending ducts 42 and 44. Ducts 42 and 44 are respectively connected to two blower fan housings 46 and 48, which are mounted on the roof of drying section 14. Another exhaust stack 50, employed to withdraw heating steam from the outlet end of veneer dryer 10 according to the present invention, extends upwardly from hood 18.

Figure 2:
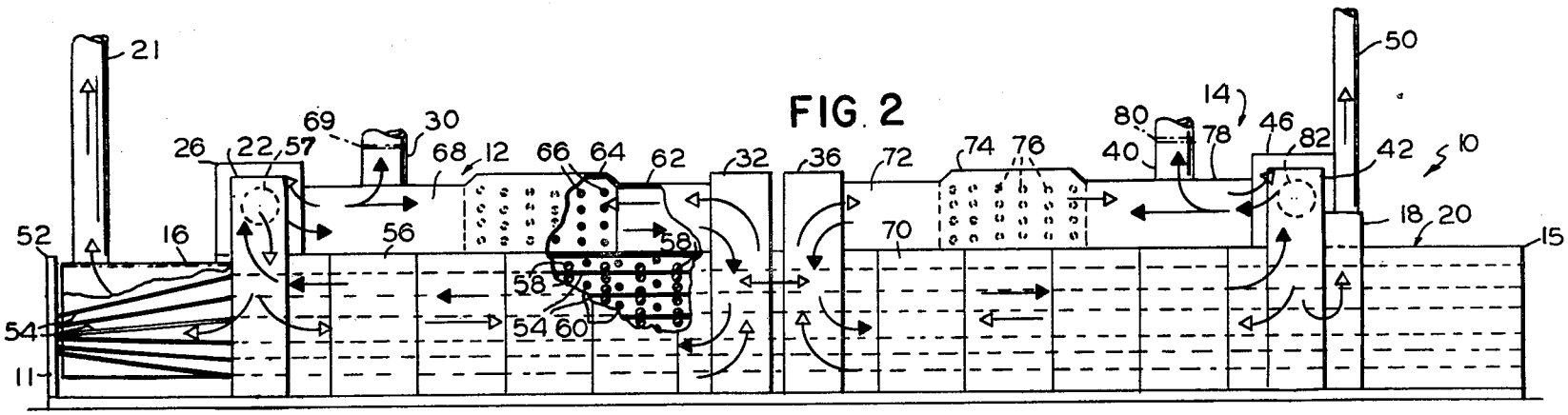
FIG. 2 is a side view of the embodiment shown in FIG. 1 with parts broken away for clarity.

Referring to FIG. 2, hood 16 and stack 21 are supported by dryer entrance frame 52 at the inlet end 11. A plurality of veneer sheets 54 are introduced through the inlet end 11 into the drying zone of dryer 10, in this case such drying zone is a drying chamber 56, which occupies the bottom part of green end drying section 12.

Vertical duct 22 is provided with an internal manifold apparatus (not shown) for introducing superheated drying steam in a plurality of paths between veneer sheets 54 at the entrance to drying chamber 56. The drying steam is forced downwardly into duct 22 by a gas impelling means such as a blower fan 57 mounted within fan housing 26. Vertical duct 24 is likewise equipped with manifold apparatus (not shown) for directing superheated drying steam in plural paths between veneer sheets 54. Drying steam is likewise forced downwardly through duct 24 by a blower fan within housing 28, identical to blower fan 57.

Veneer sheets 54 are conveyed through green and drying chamber 56 between horizontal rows of vertically and longitudinally spaced conveyor rollers 58, which are conventional in design, their operation being well known in the veneer drying art. Drying sections are normally of the order of 50 feet in length or more. Drying chamber 56 is further equipped with heat exchange pipes 60, through which a suitable heat exchange fluid, such as boiler steam at 250 psi pressure, is passed to heat the drying steam as it passes through chamber 56 between veneer sheets 54.

In operation of green end drying section 12 according to the present invention (the desired flow being indicated by outlined arrows), a drying gas consisting essentially of superheated drying steam at a dry bulb temperature above 212° F. is blown downwardly through ducts 22 and 24. A minor portion of the drying steam is blown toward the inlet end 11 of veneer dryer 10 and passes into hood 16. Being relatively hot and light, this portion of the superheated steam rises and passes through hood 16 into stack 21. The small amount of steam removed via stack 21 may be treated, in any desired manner, to remove pollutants before it is discharged into the atmosphere. A major portion of superheated drying steam blown into ducts 22 and 24 is conveyed into drying chamber 56 between the plurality of sheets 54 of wood veneer therein. The superheated drying steam passes to the right downstream through chamber 56 toward ducts 32 and 34. The heat of the superheated steam passing through chamber 56 is maintained at the desired temperature by heat exchange contact with pipes 60 spaced throughout chamber 56.

At the outlet end of chamber 56, the used drying steam is withdrawn from chamber 56 into vertical ducts 32 and 34. The used steam is passed upwardly through ducts 32 and 34 into a horizontal top duct 62. Duct 62 conveys the steam through a superheated heat exchange chamber 64, positioned above drying chamber 56.

As shown in the cutaway portions of FIGS. 1 and 2, heat exchange chamber 64 is equipped with a plurality of conventional, finned, closely spaced heat exchange pipes 66, through which a suitable high temperature heat exchange fluid, such as the same pressurized steam in pipes 60, is passed in order to heat the used drying steam from duct 62 to the desired high temperature of, for example, about 350° F. The heated drying steam is withdrawn from heat exchange chamber 64 through a horizontal duct 68 and returned to fan housings 26 and 28 as recycled steam. The recycled drying steam is then fed into vertical ducts 22 and 24 as described above. According to the present invention, the conventional exhaust stack 30 is completely blocked off by baffle 69, so that none of the freshly heated steam passing into duct 68 from heat exchange chamber 64 will be exhausted through stack 30.

Gas impeller means, in this case blower fan at the inlet end of green end drying section 12, including blower fan 57 in fan housing 26 and the fan (not shown) in housing 28 are used to move the steam throughout drying section 12. These fans produce a slightly higher-than-ambient pressure stream of superheated steam in vertical ducts 22 and 24. This slightly positive pressure is rapidly dissipated after the steam is passed between the veneer sheets 54 into drying chamber 56 and extends over only a minor portion of the length of the drying chamber 56 from its inlet end. Within chamber 56, suction from the blower fans creates a slightly less-than-ambient pressure extending from a point about 5 feet to the right of the inlet end of chamber 56 throughout the major portion of chamber 56, ducts 32 and 34, ducts 62, and, to some degree, through heat exchange chamber 64. As steam passes through heat exchange chamber 64, because of heating its pressure rises from slightly subatmospheric back to atmospheric, or slightly higher. A particular advantage of the blower and exchanger arrangemeent of the present invention is thereby provided, in that the blower fans in housings 26 and 28 may operate more efficiently, since they are used for blowing a higher pressure gas than they would if the steam were passed through them before reaching the heat exchanger. The fans force out steam at higher than ambient pressure to insure that no ambient air enters the inlet of drying chamber 56. The positive pressure at the inlet end of chamber 56 blocks air entry.

Operation of the dry end section 14 of veneer dryer 10 is similar to that of green end section 12. Drying section 14 includes a drying zone, in this case drying chamber 70, which contains conventional conveyor rolls and heat exchange pipes (not shown) like those in green end drying chamber 56. The flow of superheated drying steam through drying chamber 70 (shown by outlined arrows) is to the left toward vertical ducts 36 and 38. Used drying steam withdrawn from chamber 70 is passed upwardly through ducts 36 and 38 into a horizontal duct 72, through which the steam is passed into another heat exchange chamber 74. Heat exchange chamber 74 contains conventional finned heat exchange tubes 76, through which a suitable high temperature heating fluid is passed to heat the drying steam flowing from duct 72 to a higher temperature of, for example, about 350° F. After the desired amount of heating in chamber 74, the resulting high temperature superheated drying steam is passed into a horizontal duct 78 and on to the fan housings 44 and 46. According to the present invention, conventionally placed stack 40 is completely sealed by emplacement of baffle 80 therein to prevent the escape of steam through such stack.

Fan housing 46 is equipped with a blower fan 82. Fan housing 48 is equipped with an identical blower fan (not shown). Heated drying steam conveyed from duct 78 into housings 46 and 48 is blown by the blower fans downwardly through vertical ducts 42 and 44 into dry end drying chamber 70. The drying steam blown into ducts 42 and 44 is conveyed into chamber 70 through a manifold apparatus (not shown) in duct 42 and similar manifold apparatus in duct 44 into a plurality of paths between the sheets 54 of veneer, to evenly distribute the steam throughout chamber 70. A minor portion of the superheated steam directed downward through ducts 42 and 44 is withdrawn from the downstream end of drying section 14 and passed into hood 18. This small amount of steam being hot and light, it rises and passes upwardly through stack 50 for exhausting to the atmosphere after appropriate pollution control treatment.

Previously, veneer dryers have been constructed to operate by passing hot air over wood veneer sheets in the manner depicted by the solid arrows in FIGS. 1 and 2. The blowing and heating arrangements, as well as air flow, in conventional dryers have been essentially opposite to that employed in the drying method and apparatus of this invention. Prior art veneer dryers have not been equipped with the hoods 16 and 18 or stacks 21 and 50 shown on dryer 10. Instead, for example, in operation of a green end drying section, such as section 12, ambient outside air has been drawn into the inlet end of the dryer and upward into ducts, such as ducts 22 and 24, where the outside air has been mixed with hot air recovered from the drying chamber, such as chamber 56. A large portion of the resulting mixture of used hot air and fresh outside air has then been exhausted from the dryer through a conventionally placed stack, such as stack 30 in section 12. This creates severe problems due to the loss of heat energy and the large amount of pollutants emitted into the atmosphere. The remainder of the air mixture has then been passed through a heat exchange chamber, such as chamber 64, and through ducts, such as duct 62 and ducts 32 and 34, into a drying chamber such as chamber 56.

By operating in accordance with the present invention and passing used superheated drying steam recovered from chamber 54 directly into heat exchange chamber 64, substantially the whole of drying chamber 54 is maintained at less than ambient atmospheric pressure by the suction of the fans. Leakage of any pollutant-laden drying gas outward through door seals and cracks in the walls of chamber 56 into the atmosphere around veneer dryer 10 is thereby prevented. In contrast, conventional veneer dryer operations have been troubled by "fugitive emission" leakage of pollutant-laden drying air into the ambient atmosphere from the drying chamber due to the positive pressure created within such chambers.

Drying conditions other than those specified herein for use in carrying out this invention in veneer dryers such as dryer 10 are known in the veneer drying art. For example, the length of time to which veneer sheets are subjected to drying depends upon the moisture content of the particular wood before drying and also upon the moisture content desired for the dried veneer. The exact temperature of the superheated steam above 212° F. and the time period employed can be selected to obtain a desired moisture content in the dried veneer. Usually, good results are obtained by maintaining the drying steam at a dry bulb temperature above about 240° F. and a wet bulb temperature of 212° F. Particularly good results may be achieved using drying steam at a dry bulb temperature between about 350° F. and 400° F. and a wet bulb temperature of 212° F.

By using a drying gas consisting essentially of superheated steam at a wet bulb temperature greater than 212° F., I have been able to substantially increase the production capacity of a conventional veneer drying unit, e.g., by 50 percent or more, when it has been modified in accordance with the present invention. Increases in production capacity of as much as 75 percent have been obtained. Although not essential to an understanding of the present invention, I believe that such striking improvement in capacity and efficiency in veneer drying obtained using the present process and apparatus is due, at least in part, to the superior ability of superheated steam to transmit heat to liquid water contained in the veneer sheets, as compared with conventional hot air. Not only do the present process and apparatus substantially decrease the amount of time necessary to dry veneer sheets, but the dried veneer product produced according to the present invention also has a more uniform moisture content than is found in dried veneer produced according to conventional methods.

An important aspect of the present drying process, as used for drying wood veneer, is the continuous recirculation or recycling of a drying gas consisting essentially of superheated steam, with only a small portion of the heated steam being continuously withdrawn from the drying apparatus and discarded. Preferably, the minor portion of steam which is thus discarded contains an amount of water substantially equal to the amount of water evaporated from the veneer sheets and forming additional steam when if mixed with the remaining superheated drying steam that was previously formed in a similar manner within the drying chamber. In this way, the pressure of the system and the steam flow rate are automatically regulated at a proper level. By exhausting this portion, the amount of circulating steam is kept constant, so that the pressure is also constant inside the system.

An important feature of the invention in veneer dryers is heating the drying steam when it is removed from drying zones, such as drying chambers 56 and 70, before it is reintroduced into such zones by the blower fan or other gas impelling means. The impeller then provides a positive pressure at the inlet to the dryer to prevent entry of ambient air, while suction from the impeller provides a negative pressure within the drying zone. The system provides automatic bleeding of substantially all of the moisture which is removed from the veneer sheet within the drying zone. This small amount of exhaust steam or gas can easily and inexpensively be treated for pollution control, e.g., removal of hydrocarbonaceous vapors before being released into the atmosphere.

The practice of the drying method of this invention as used for drying wood veneer sheets is not restricted to the longitudinal flow veneer dryer apparatus depicted in FIGS. 1 and 2. Substantially any conventional veneer drying apparatus may be converted to the practice of the present invention by the alterations therein shown in FIGS. 1 and 2. For example, the method of the present invention may be utilized in veneer dryers employing cross flow jet drying systems or other types of conventional drying apparatus.

Figure 3:
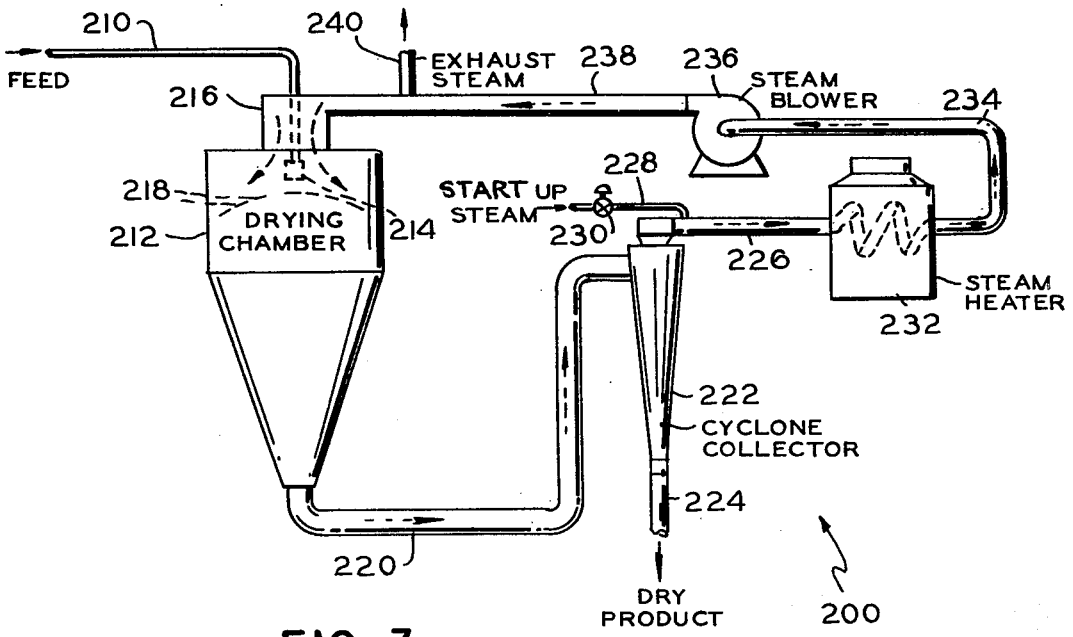
FIG. 3 is a schematic representation of another embodiment of the present invention used for drying particulate materials.

The present method and apparatus are also useful in drying particulates or other solids of relatively small cross-sectional diameter. FIG. 3 shows a preferred embodiment 200 of such a dryer, which may be employed in drying organic particulate materials, such as seeds. In dryer 200, wet seeds are fed through conduit 210 into a drying zone within drying chamber 212 as a water-seeds slurry. Even distribution of the seed particles within drying chamber 212 is obtained using a conventional distributor 214 at the end of conduit 210 within the top of chamber 212. Superheated drying steam at a temperature of 300° F. is introduced into drying chamber 212 from annular steam distributing conduit 216 surrounding conduit 210. The pressure within drying chamber 212 is maintained at slightly less than the ambient pressure during the drying operation in a manner hereafter described.

The seeds and drying steam pass downwardly through drying chamber 212. Contact between the seeds and drying steam is facilitated by a perforated plate 218, located beneath the distributor 214 in chamber 212, so that the seeds strike such plate and are spread uniformly across the width of the chamber before they fall through the chamber. The seeds and used steam are removed from the bottom of chamber 212 through conduit 220 in admixture. They are passed through conduit 220 into a conventional cyclone collector 222, which separates the dried seeds from the steam. The dried seeds are removed from the bottom of cyclone 222 through conduit 224. The used drying steam, after separation from the seeds product, is removed from the top of cyclone 222 through conduit 226.

During startup of the seed drying system 220, and before charging any wet seeds into the drying chamber 212, it is generally necessary to begin circulation of steam within the closed loop of the apparatus with an auxiliary source of water. For this purpose, a small amount of water is introduced into conduit 226 through a valved conduit 228. The amount of water thus introduced is sufficient to provide steam for beginning operation of the system. Once the required amount of water is introduced, valve 230 is closed off, and no further auxiliary water is introduced into the system so that the drying steam is produced within the drying chamber by water evaporated from the seeds or other material being dried.

In normal operation, used steam is passed from cyclone 222 through conduit 226 into steam superheater 232. After the drying steam is heated above 212° F. to provide superheated steam, it is withdrawn from heater 232 and passed through conduit 234 into a fan blower 236. Blower 236 forces the heated steam into conduit 238, from which it is passed into distributing conduit 216 for injection into the drying chamber 212 as described above.

When the superheated drying steam is provided in contact with wet seeds in drying chamber 212, part of the heat in the steam is used to vaporize water in the seeds. Accordingly, the temperature of the drying steam is reduced within the drying chamber, from the high temperature level at which the steam is introduced, to a lower temperature at which the steam is removed from chamber 212 in conduit 220. In normal operation, there is a slightly larger amount of steam leaving chamber 212 via conduit 220 than is introduced into chamber 212, because of the addition of vaporized water removed from the dried seeds within chamber 212 to the drying steam. Because of the drop in temperature of the drying steam within chamber 212, and the evacuating action of the blower 236, the steam within chamber 212, conduit 220, and collector 222 is at less than atmospheric pressure. This negative pressure prevents hydrocarbon vapor and other pollutants produced by the seeds during drying from being emitted to the ambient atmosphere through cracks in chamber 212, conduit 220, or collector 222. The negative pressure is achieved even though there is a larger amount of gaseous water, by weight, removed from the drying chamber than enters such chamber. This is because the withdrawn steam has a lower temperature.

After the used drying steam is separated from the dried seed product in cyclone collector 222, the used steam is heated to a high temperature of, for example, 350° F. in heater 232. For this reason, the heated steam in conduit 234 is at a relatively higher pressure than that in conduit 226. However, the steam in conduit 238 is at atmospheric pressure because such conduit is provided with an exhaust stack 240 which exhausts a minor portion of the steam to the ambient atmosphere. Any excess pressure over atmospheric pressure which tends to be produced in conduit 238 is reduced to at least atmospheric pressure or lower by the passage of the minor portion of the drying steam in conduit 238 out of the system through stack 240. The small amount of exhausted steam has substantially the same amount of water as that removed from the seeds during drying within drying chamber 212. This small amount of exhaust steam is easily and inexpensively treatable to remove any pollutants before it is released.

By recycling drying steam continuously through the apparatus 200, the only heat energy required to be introduced into the apparatus via steam heater 232 is the small amount necessary to vaporize the water contained in the seeds entering chamber 212 and the amount of heat needed to raise the temperature of the water vapor thus produced to the temperature of the drying steam in conduit 234.

The preferred embodiments having been described, the broad scope of the invention will be apparent to those skilled in the art. The limitations of the invention will be defined by the appended claims.

I claim:

1. A drying method for removing water from a water containing material to provide a dried product which comprises the steps of:

contacting said water containing material, in a drying zone at drying conditions, with a recycled drying fluid comprising at least a major portion of superheated steam at a first temperature above the boiling temperature of water, whereby at least a portion of the water in said material is vaporized, removed from said material, and comingled with said drying fluid to form an effluent gas stream comprising steam at a second temperature lower than said first temperature;

removing said effluent gas stream from said drying zone and heating said effluent gas stream to about said first temperature;

discarding a minor first portion of said heated effluent gas stream and recycling a major second portion of said heated effluent gas stream to said drying zone to provide said recycled drying fluid;

producing a negative pressure in said drying zone along at least a major portion of its length, said negative pressure being below the ambient pressure of the atmosphere surrounding said drying zone; and transporting said material through said drying zone along its length from an inlet to an outlet during drying and removing said material from said outlet to provide said dried product.

2. A drying method according to claim 1 wherein ambient air is prevented from entering said drying zone.

3. A drying method according to claim 1 wherein said first portion of said effluent gas stream includes about the same amount of water as said portion of water removed from said material in said drying zone.

4. A drying method according to claim 1 wherein said water containing material is wood veneer which is transported through said drying zone.

5. A drying method according to claim 1 wherein said first temperature is above 240° F.

6. A drying method according to claim 1 wherein said first temperature is between about 350° F. and about 400° F.

7. A method of drying wood veneer comprising the steps of:

positioning the wood veneer in a drying zone;

contacting said veneer with a moving stream of drying fluid comprising at least a major portion of steam in said drying zone to vaporize and remove at least a portion of the water in said veneer;

producing a negative pressure in said drying zone along at least a major portion of its length, said negative pressure being below the ambient pressure of the atmosphere surrounding said drying zone; and transporting said veneer through said drying zone along its length from an inlet to an outlet during drying and removing dried veneer from said outlet of said drying zone.

8. A drying method in accordance with claim 7 in which the drying fluid comprises superheated steam, said drying fluid being removed from the drying zone after it commingles with the vaporized water from said veneer and heated to a higher temperature to provide said superheated steam which is returned to the drying zone.

9. A drying method in accordance with claim 7 in which ambient air is prevented from entering the inlet and outlet of the drying zone to reduce the ambient of ambient air entering said drying zone.

10. A drying method in accordance with claim 22 in which the drying zone includes an inlet chamber having a veneer inlet opening and an outlet chamber having a veneer outlet opening, and the drying fluid includes a first stream flowing through said inlet chamber away from said inlet opening and a second stream flowing through said outlet chamber away from said outlet opening.

* * * * *

UNITED STATES PATENT AND TRADEMARK OFFICE

CERTIFICATE OF CORRECTION

PATENT NO. : 4,127,946

DATED : December 5, 1978

INVENTOR(S) : ADOLF BUCHHOLZ

It is certified that error appears in the above-identified patent and that said Letters Patent are hereby corrected as shown below:

Column 2, line 14, after "has" insert --not--.

Column 3, line 60, "dying" should be --drying--.

Column 3, line 60, "1." should be --14--.

Column 4, line 25, "and" should be --end--.

Column 10, Claim 9, line 48, "ambient" should be --amount--.

Column 10, Claim 10, line 50, "claim 22" should be --claim 7--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*